United States Patent [19]

Sweet

[11] 4,159,697

[45] Jul. 3, 1979

[54] ACCELERATION ENRICHMENT CIRCUIT FOR FUEL INJECTION SYSTEM HAVING POTENTIOMETER THROTTLE POSITION INPUT

[75] Inventor: Charles R. Sweet, Royal Oak, Mich.

[73] Assignee: The Bendix Corporation, Southfield, Mich.

[21] Appl. No.: 729,327

[22] Filed: Oct. 4, 1976

[51] Int. Cl.[2] ..... F02B 3/00

[52] U.S. Cl. ..... 123/32 EH; 123/32 EG; 123/32 EA

[58] Field of Search ..... 123/32 EH, 32 EA, 32 EG, 123/119 R

[56] References Cited

U.S. PATENT DOCUMENTS

| | | | |
|---|---|---|---|
| 3,593,692 | 7/1971 | Scholl | 123/119 R |
| 3,672,345 | 6/1972 | Monpetit | 123/32 EH |
| 3,747,576 | 7/1973 | Gordon et al. | 123/32 EH |
| 3,786,788 | 1/1974 | Suda et al. | 123/119 R |
| 3,792,693 | 2/1974 | Luchaco | 123/32 EG |
| 3,827,409 | 8/1974 | O'Neill | 123/32 EA |
| 3,858,561 | 1/1975 | Aono | 123/32 EA |
| 3,913,536 | 10/1975 | Lapple et al. | 123/32 EA |

OTHER PUBLICATIONS

"Solid State Circuit Design," by J. Oleksy, Sams & Co. Inc., 1974, pp. 130, 131.

*Primary Examiner*—Charles J. Myhre
*Assistant Examiner*—P. S. Lall
*Attorney, Agent, or Firm*—Gaylord P. Haas, Jr.; Russel C. Wells

[57] ABSTRACT

An acceleration enrichment pulse generation circuit which is utilized to generate enrichment pulses, the frequency and duration of which are controlled in accordance with the rate of change of throttle position sensed by a linear potentiometer, the angle function of the throttle position and the engine coolant temperature. The circuit also includes a closed throttle signal generator and a wide open throttle signal generator. The control circuit includes a differentiator which controls the output frequency of a voltage controlled oscillator, the voltage level of the output from the differentiator being indicative of the rate of change of the throttle position. This frequency output signal is fed to a single shot multivibrator to control the duty cycle of the single shot multi-vibrator and thus the duty cycle of the acceleration enrichment pulses being fed to the fuel injectors. The operation of the single shot multivibrator is varied by the throttle angular position function and the engine coolant temperature.

15 Claims, 8 Drawing Figures

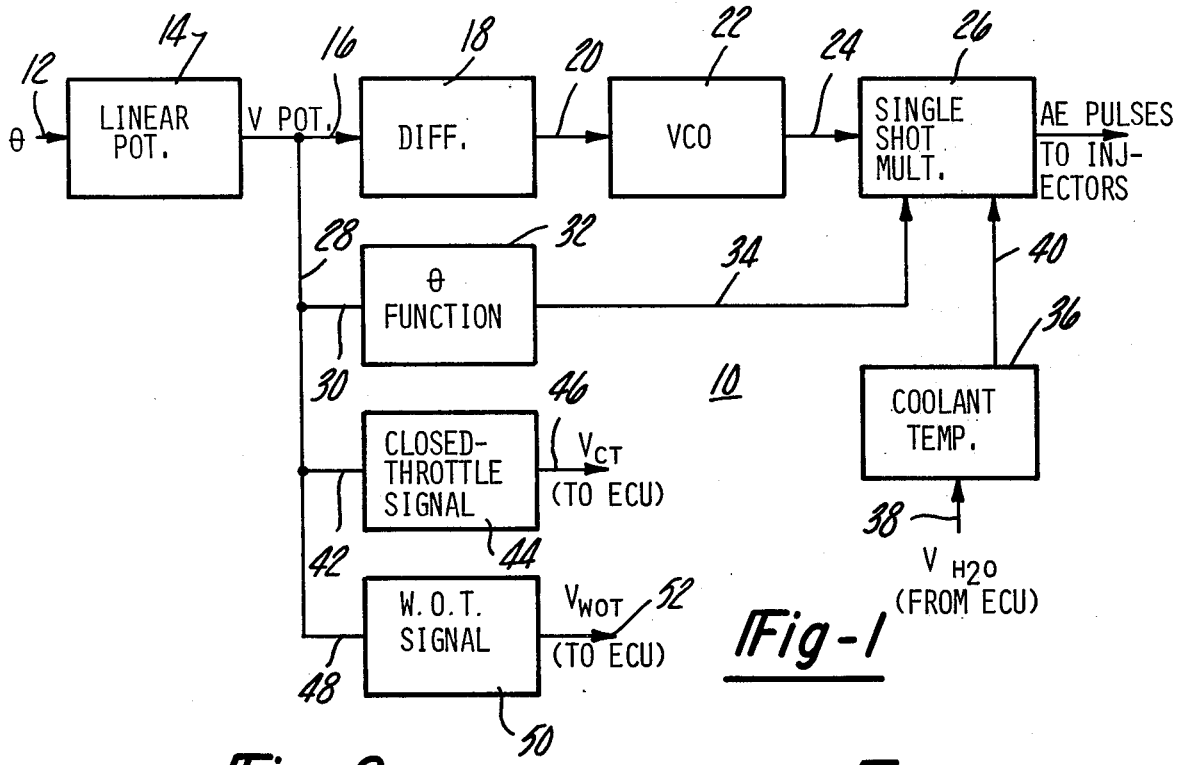
Fig-1
Fig-2
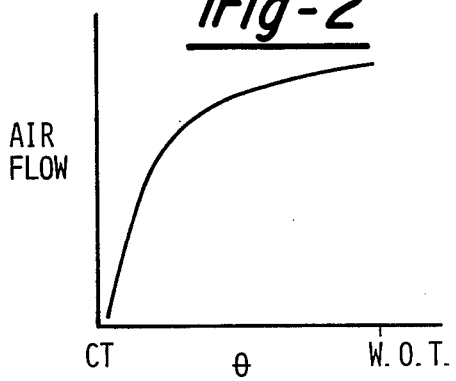
Fig-3
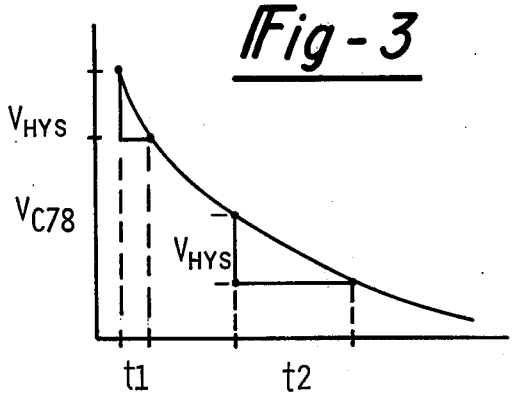
Fig-4
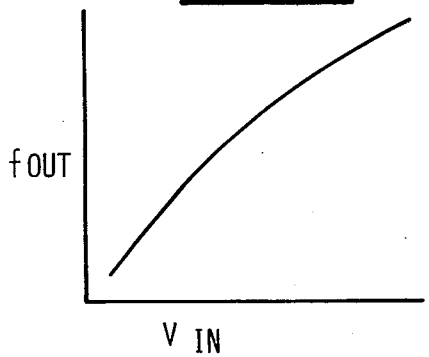
Fig-5
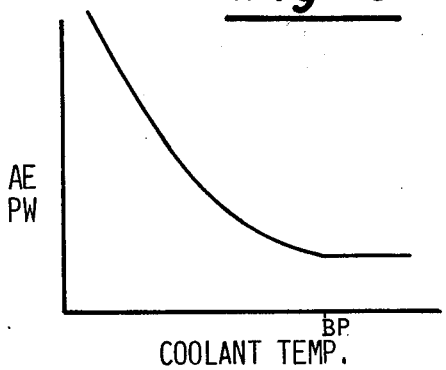

ACCELERATION ENRICHMENT CIRCUIT FOR FUEL INJECTION SYSTEM HAVING POTENTIOMETER THROTTLE POSITION INPUT

BACKGROUND OF THE INVENTION

The impending fuel shortage and the increased pressure to reduce pollution resulting from the incomplete combustion of fuel in internal combustion engines, coupled with the tremendous advances in the electronic arts, has provided great impetus to the development of fuel injection systems for internal combustion engines. Such fuel injection systems are highly versatile in sensing engine operating parameters and providing the exact fuel requirements to the engine for particular operating conditions. One such operating condition is the changing of the throttle position which requires an immediate enrichment of the fuel being fed into the engine. Thus, acceleration enrichment circuits have been evolved for electronic fuel injection systems to provide additional fuel in an attempt to immediately meet the fuel requirements of the engine in response to a change in throttle position.

Many acceleration enrichment circuit schemes have been evolved to provide accurate control of fuel delivery over the entire operating range of the engine, including acceleration and deceleration of the engine due to a change in throttle position. Also, certain other requirements of controlling engine operation through fuel control involves generating a signal which is representative of the closed throttle position and the wide open throttle position. Typical prior schemes for the generation of acceleration enrichment pulses are disclosed in U.S. Pat. No. 3,593,692, entitled "Electrical Fuel Injection Arrangement For Internal Combustion Engines" issued to H. Scholl et al., U.S. Pat. No. 3,720,191, entitled "Acceleration Enrichment Circuitry For Electronic Fuel Systems" issued to T. L. Rachel, U.S. Pat. No. 3,726,261, entitled "Acceleration Enrichment Signalling Means For Electronic Fuel Systems," issued to R. G. Sauer, and U.S. Pat. No. 3,926,153, entitled "Closed Throttle Tip-In Circuit," issued to Junuthula N. Reddy.

Referring first to the Scholl patent, fuel enrichment during acceleration is provided by an acceleration enrichment switch attached to the throttle which generates electrical pulses as the throttle is advanced or opened. These pulses are subsequently converted by the fuel control computer into fuel injection pulses which increase the fuel delivery to the engine during acceleration or as a result of opening the throttle. In the Rachel and Sauer patents, a lost motion link is connected between the accelerator pedal and the throttle and a potentiometer generating an electrical signal is mechanically linked to the accelerator pedal. The combination of the accelerator pedal, potentiometer and lost motion link to the throttle provide a means for generating an acceleration demand signal prior to the actual movement of the throttle. Sauer provides two separate circuits for providing fuel enrichment to the engine. The first circuit increases the length of the electrical pulse provided by the electronic computer in proportion to the rate and magnitude of the acceleration demand. The second circuit initiates an immediate electrical pulse to the fuel injectors when the rate and magnitude of acceleration demand exceeds predetermined limits.

The electronic fuel control systems disclosed by Scholl, Rachel and Sauer appear to provide adequate acceleration fuel enrichment when the engine is operating with the throttle at least partially open. However, upon initial commencement of opening movement of the throttle from the closed position there is a momentary lag between the demand for acceleration and the actual response to the engine. For example, in the system disclosed by the Scholl patent, the fuel enrichment pulses are not generated until the throttle is rotated through a predetermined angle to a position where the acceleration switch produces the first pulse. Because of this angular dependency, the time when the first acceleration enrichment pulse is generated is a function of the amount of initial rotation of the throttle.

The Reddy system relates to a throttle tip-in circuit for generating an acceleration fuel enrichment pulse each time the closed throttle signal is terminated when the operator tips in the throttle. The Reddy circuit senses the termination of the closed throttle signal and generates a fuel enrichment pulse independent of the magnitude or rate at which the throttle is open.

As to the Scholl circuit, a certain problem has arisen with respect to the reliability of the circuit. The potentiometer utilized in the Scholl circuit is stepped in nature and does not provide a linear output per degree of angular rotation of the throttle. Further, the resolution of the Scholl system is somewhat limited due to the design of the potentiometer utilized in providing an output signal indicative of the throttle position. It has been found that a continuous signal from a potentiometer is far more desirable to provide a more complete control over the operation of the engine in terms of moving from closed throttle position and in terms of wide open throttle position performance. Further, the Scholl circuit is complex in nature and therefore expensive to manufacture and install.

In a patent to Toshi Suda et al., U.S. Pat. No. 3,786,788, issued Jan. 22, 1974, there is proposed a fuel injection apparatus for an internal combustion engine, the apparatus including a throttle position sensor that produces an analog signal representative of throttle position and thus air velocity to the engine. This throttle position sensor provides a signal to an astable multivibrator circuit, the output frequency of which varies as a function of variations in the throttle position signal. This frequency signal is shaped by means of a pulse shaping circuit, the pulse shaping circuit producing output pulses at the same frequency as the input pulse chain. The output of the shaping circuit is fed to a monostable multivibrator which provides an output pulse train having a fixed on-time and an off-time which varies as a function of the frequency of the pulse train being fed from the shaping circuit. The output of the monostable multivibrator is fed to a current driver circuit which, in turn, is connected to control the solenoid valves associated with the injectors. It will be noted that this Toshi Suda circuit is not an acceleration enrichment circuit which is responsive to the rate of change of throttle position to vary the output pulses to the injectors.

SUMMARY OF THE INVENTION

This invention relates generally to an acceleration enrichment pulse generation circuit and more specifically to an acceleration enrichment pulse generation circuit utilizing a linear potentiometer input to provide an indication of the rate of change of throttle position, this rate of change signal controlling the frequency of an oscillator circuit which, in turn, controls the duty cycle of the fuel enrichment pulses being generated.

In general, the preferred embodiment of the system of the present invention includes a linear potentiometer which is interconnected with the throttle linkage to provide a linear output signal in response to the angular position of the throttle. The output signal from the linear potentiometer, designated $V_{POT}$, is fed to a differentiator circuit which generates an output signal having an amplitude which varies in response to the rate of change of throttle position. The positive output voltage from the differentiator circuit is fed to a voltage controlled oscillator, the output frequency of the voltage control oscillator being directly related to the amplitude of the output signal from the differentiator circuit. The voltage controlled oscillator controls the pulse frequency of the output of a single shot multivibrator circuit, the multivibrator circuit controlling the acceleration enrichment pulses being fed to the injectors.

The preferred system includes circuits for modifying the operation of the single-shot multivibrator circuit. Particularly, a circuit is provided which is responsive to the angular function of the throttle position sensor, designated $\ominus$ function, which alters the charging circuit associated with the single shot multivibrator. At wide open throttle, this alteration circuit decreases the time constant of the charge circuit in response to the output signal from the $\ominus$ function circuit. Further, the system includes an engine coolant temperature sensing circuit which provides an output signal in response to variations in coolant temperature to vary the reference voltage of the single-shot multivibrator circuit. Specifically, the reference voltage of the multivibrator circuit is increased with decreasing sensed temperature to increase the duration of the output acceleration enrichment pulse.

The preferred embodiment of the system of the present invention also includes a circuit for providing an output signal which indicates the closed throttle position of the throttle mechanism to provide a signal which, for example, may be used to disable the EGR control at idle. Further, the system includes a circuit for indicating the wide open throttle position, which wide open throttle signal will indicate to the electronic fuel injection system that additional enrichment is needed for the engine due to the fact that the throttle has been moved to the wide open position.

With the system described above, it is seen that improvements have been made whereby the system of the present invention will provide greater reliability due to the fact that small incremental changes in throttle position may be sensed and particularly the system better fits fuel demands of the engine at or near the closed throttle position. It is at the closed throttle position where changes in air flow relative to changes in throttle position are extremely great. Further, the system of the present invention is extremely simple and inexpensive to manufacture, thereby providing a lower cost in utilizing electronic fuel injection systems to control the fuel flow to internal combustion engines. In this way, the use of electronic fuel injection systems will become more widespread resulting in a fuel saving and reduction in pollutants being introduced to the atmosphere.

OBJECTS AND BRIEF DESCRIPTION OF THE DRAWINGS

Accordingly, it is one object of the present invention to provide an improved acceleration enrichment pulse generation circuit.

It is another object of the present invention to provide an improved pulse generation circuit for use in acceleration enrichment systems whereby the throttle position is sensed by means of a linear potentiometer.

It is a further object of the present invention to provide an improved acceleration enrichment pulse generation circuit which is better suited to engine fuel demands and has high resolution of changes in throttle position from the closed throttle position.

It is another object of the present invention to provide an improved frequency modulated acceleration enrichment pulse generation circuit which is simple and reliable, while still providing extremely fine control of the acceleration enrichment pulses in response to throttle position, rate of change of throttle position, and sensed engine temperature.

It is another object of the present invention to provide an improved wide open throttle signal generator, and closed throttle signal generator.

It is still a further object of the present invention to provide improved acceleration enrichment pulse generation circuit for use in connection with an electronic fuel injection system which is simple to manufacture and reliable in operation.

Further objects, features and advantages of the present invention will become readily apparent from a consideration of the following description, the appended claims and accompanying drawings in which:

FIG. 1 is a block diagram illustrating certain features of the preferred embodiment of an acceleration enrichment pulse generation circuit of the present invention;

FIG. 2 is a graph illustrating the relationship between engine air flow and throttle position with a typical butterfly-type throttle valve;

FIG. 3 is a graph illustrating the relationship of the voltage across capacitor 78 relative to time during the discharge portion of the operation of the voltage controlled oscillator circuit;

FIG. 4 is a graph illustrating the relationship between the output frequency from the voltage controlled oscillator relative to the input voltage thereto;

FIG. 5 is a graph illustrating the relationship between the acceleration enrichment pulse width and the coolant temperature, and further illustrating the breakpoint in that curve as coolant temperature increases beyond a certain level;

DETAILED DESCRIPTION OF A PREFERRED EMBODIMENT OF THE INVENTION

Figure 8:
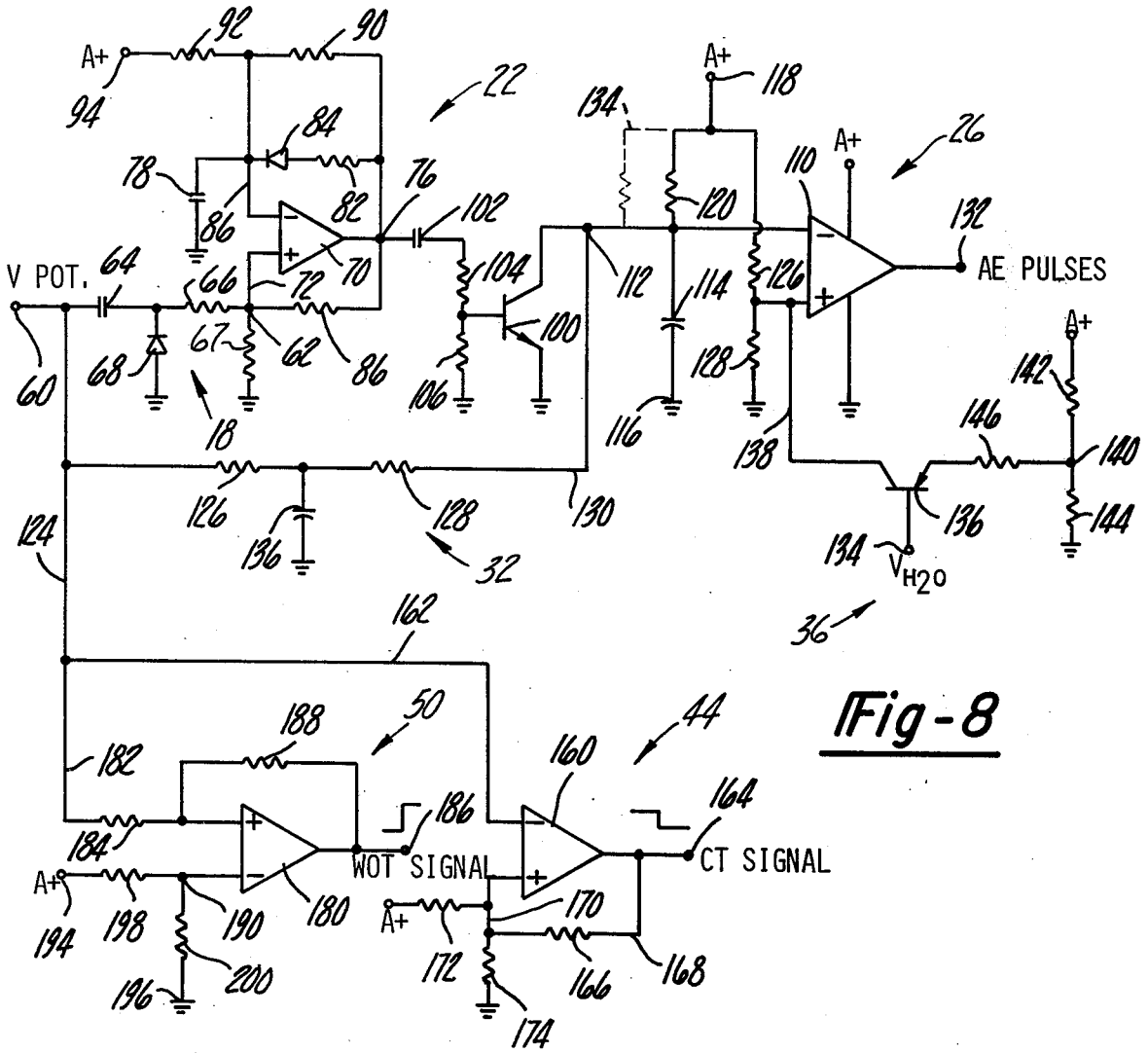
FIG. 8 is a schematic diagram illustrating the circuit details of a preferred embodiment of the system illustrated in the block diagram of FIG. 1.

Referring now to the drawings, and particularly to FIG. 1 thereof, there is illustrated a system 10 for generating acceleration enrichment pulses which are fed to the injector or injectors of an electronic fuel injection system to provide additional fuel to the engine under certain conditions of operation of the throttle. Specifically, the throttle position is fed to the pulse generating system 10, and particularly to a linear potentiometer 14, by means of a throttle shaft representatively illustrated as line 12. In the preferred embodiment, the linear potentiometer is a 5 kilohm potentiometer. The output of the potentiometer circuit 14 generates an analog voltage, designated $V_{pot}$, on a conductor 16, the conductor 16 being connected to the input of a differentiator circuit 18. The differentiator circuit 18 generates positive and negative voltages, the amplitude of which are directly related to the rate of change of $V_{pot}$. The differentiator circuit also includes a means for discriminating between the positive and negative voltages and feeding only the positive voltages to the output conductor 20.

The output conductor 20 is connected to the input circuit of a voltage controlled oscillator 22 which generates a pulse train on output conductor 24 having a frequency $f_{out}$ directly proportional to the amplitude of the signal on conductor 20. The voltage controlled oscillator is connected to an output conductor 24 which feeds the frequency signal $f_{out}$ to a single-shot multivibrator circuit 26. The multivibrator circuit 26, in turn, generates the acceleration enrichment pulses which are fed to the injector.

Thus far, the operation of the single-shot multivibrator circuit is directly related to the frequency output of the voltage controlled oscillator circuit 22 and will produce output pulses having a fixed duration with a variable off time, the off time varying in accordance with the frequency from the voltage controlled oscillator. However, a first modification circuit for the multivibrator circuit 26 is provided whereby the $V_{pot}$ signal on a conductor 28 is fed through a conductor 30 to a $\ominus$ function circuit 32, the $\ominus$ function circuit providing an analog voltage signal which is at ground for the closed throttle position and approaches the positive bias voltage for the system at wide open throttle. The output of this circuit is fed to the single-shot multivibrator circuit 26 by means of a conductor 34. The signal on conductor 34 operates on the multivibrator circuit 26 to modify the operation of the multivibrator circuit 26 by varying the charging circuit of the capacitor associated with the multivibrator.

Also, the multivibrator operation is modified by means of a coolant temperature circuit 36 which is provided a signal from the engine through an electronic control unit, the signal on conductor 38 being an analog voltage representative of the temperature of the engine coolant. Accordingly, as the engine coolant temperature decreases, the input voltage on conductor 38 will also decrease to provide an increasing current flow on conductor 40. This increased current flow on conductor 40 is fed to the reference circuit of the multivibrator 26 to alter the output pulses from the multivibrator circuit by increasing the pulse width in response to a decrease in sensed temperature.

The system illustrated in FIG. 1 further includes a provision for generating a signal which is representative of the throttle being in the closed throttle position and also a signal representative of the wide open throttle position. To this end, the analog $V_{pot}$ signal on conductor 28 is fed by means of a conductor 42 to a closed throttle signal circuit 44. This analog voltage on conductor 42 is compared to a reference voltage within the closed throttle signal circuit 44 to provide an output signal on a conductor 46 when the analog voltage on conductor 42 bears a preselected relationship to the reference. This closed throttle position is represented by a near-ground signal level on conductor 42. Similarly, the voltage level on conductor 28 $V_{pot}$, is fed, by means of a conductor 48, to a wide open throttle signal circuit 50 which compares the signal level on conductor 48 with a reference voltage within the wide open throttle signal circuit 50. When the signal voltage on conductor 48 reaches the positive bias voltage, indicating wide open throttle, the wide open throttle signal circuit will generate an output signal on conductor 52. These signals on conductors 46 and 52 are fed to an electronic control unit which is normally associated with electronic fuel injection systems.

FIGS. 2 to 7 are graphs illustrating the various relationships between air flow and throttle position, signal levels and time, frequency and voltage, pulse width and coolant temperature, pulse width and throttle position, and output voltage of the closed throttle circuit relative to throttle position which aid in the understanding of the operation of the circuit depicted in FIG. 8. The detailed descriptions of FIGS. 2 to 7 will be reserved until the appropriate point in the description of the circuit details and operation of FIG. 8.

Referring now to FIG. 8, the schematic details of the circuit depicted in block diagram form in FIG. 1 are illustrated. It is to be understood that the circuit details of FIG. 8 are purely illustrative and modifications to the circuit within the overall operational scheme of FIG. 1 may be made. The angular throttle position $\ominus$ generates a throttle position signal by means of the potentiometer described in FIG. 1. FIG. 2 illustrates the highly-sloped air flow condition near closed throttle position which necessitates a close control of the enrichment pulses.

Specifically, the potentiometer analog voltage signal, labelled $V_{pot}$, is fed to the input terminal 60, the signal being fed to the differentiator circuit which includes a capacitor 64 and two resistive elements 66, 67. This RC combination causes the generation of positive and negative voltages, the amplitude of which are directly related to the rate of change of the analog signal impressed on input terminal 60. A diode 68 is provided which grounds the negative spike and the positive spike is fed forward to a node 62. The node 62 is connected to the positive input terminal of an operational amplifier 70 by means of a conductor 72, the signal level at node 62 causing an output node 76 of operational amplifier to swing high. This high state at output node 76 causes a capacitor 78 to charge through a circuit including a resistor 82 and a diode 84. The charging of capacitor 78 is rapid and raises the voltage on a conductor 86 connected to the negative input of operational amplifier 70 to a voltage which is slightly above the voltage at conductor 72. This causes the operational amplifier 70 to swing low at the output node 76.

With the output node 76 in the low state, the capacitor 78 will discharge toward the voltage at node 76 in order to again swing the output to the high level. A resistor 86 is provided, which resistor 86 determines the level to which the capacitor must discharge in order to swing the output high again. Also, the level to which capacitor 78 charged, depending on the voltage at node 62, will also determine the discharge time. The capacitor is discharged toward the voltage at node 76 through a resistor 90, the resistor 90 at the left end thereof being connected through a resistor 92 to a positive source of potential at input terminal 94.

Since capacitor 78 always discharges toward ground, its $-dV/dt$ will be higher if it starts its discharge at a higher voltage. The higher the input voltage, node 62 at the higher the starting voltage on capacitor 78. Thus, if capacitor 78 must discharge a constant amount of voltage, set by the resistor 86, before it resets the output, the discharge time will decrease and the output frequency will increase as the input voltage increases. This condition means that a fast throttle movement will trigger a higher frequency of injection pulses than a slow throttle movement. This is best illustrated in FIG. 3 which depicts the relationship between the voltage across capacitor 78 relative to time. From FIG. 3 is seen that the voltage, designated $V_{HYS}$ and being the difference between the starting voltage and the final voltage after discharge of capacitor 78, which the capacitor must discharge is fixed irrespective of where the discharge occurs on the curve. Accordingly, if the discharge cycle takes place at a relatively high voltage across capacitor 78, the time $t_1$ will be short relative to the time it would require to discharge an equal amount of voltage when the capacitor 78 is charged to a lower level. This latter time is illustrated in FIG. 3 as Time $t_2$.

The on-time output of the voltage controlled oscillator 22 is set by the circuit parameters connected to the operational amplifier 70. However, the off-time is determined as described above to provide a variable output frequency in accordance with the voltage at input node 62.

Referring to FIG. 4 it is seen that the frequency from the voltage control oscillator circuit 22 increases exponentially with respect to the amplitude of the voltage input to the oscillator. Accordingly, for a small input from the differentiator circuit 18, the frequency output from the voltage controlled oscillator circuit 22 will be low. The frequency increases as the input voltage from the differentiator circuit 18 increases.

A high output from the voltage control oscillator 22 is fed to an NPN transistor 100 through a capacitor 102 and a pair of resistors 104, 106. This high output causes transistor 100 to start conduction to discharge a capacitor 114 connected thereto by means of a conductor 112. The opposite end of the capacitor 114 is grounded at 116. The discharge of capacitor 114 causes an output operational amplifier 110 to swing high output at an output terminal 132. This starts the acceleration enrichment pulse. The duration of the pulse is determined by three conditions, one of which is the voltage being fed to the multivibrator circuit 26 by means of the ⊖ function circuit 32, the second of which is related to the sensed temperature by means of the coolant temperature sensing circuit 36 and the third is the circuit parameters of the multivibrator circuit 26.

Upon discharging the capacitor 114, the capacitor will then start charging from the positive source of direct current potential at input terminal 118 through a resistor 120. Assuming for the moment that the ⊖ function circuit 32 is not effecting the operation of the multivibrator circuit 26, the capacitor 114 will charge from the voltage at the terminal 118 to raise the level of the voltage to the negative input of operational amplifier 110. As is normal in circuits of this type, when the negative input to operational amplifier 110 slightly exceeds the voltage at the positive input terminal, the output terminal 132 will again swing low.

This charging circuit is effected by the ⊖ function circuit to decrease the length of the pulse as the throttle is moved toward the wide open throttle position. This occurs due to the fact that the $V_{pot}$ signal at terminal 60 is fed through a conductor 124 to the resistors 126, 128. This provides a voltage to conductor 112 by means of a conductor 130 to effectively introduce a resistance, shown in phantom at 134, in the charging circuit for the capacitor 114. This lowers the effective resistance of the charging circuit for the capacitor 114 thereby decreasing the charge time. Thus, the voltage level at the negative input to operational amplifier 110 which is necessary to swing the output terminal 132 low will be achieved at a faster rate. The capacitor 136 is provided between the connection between resistors 126 and 128 and ground to introduce a delay for the signal being fed from conductor 124 to the conductor 112. This delay is introduced so that information relative to a first change in throttle position is not immediately lost.

The operational amplifier 110 is responsive to the voltage level at the conductor 138 connected to the positive input terminal of the operational amplifier 110, this voltage being effected by the temperature sensing circuit 136. Specifically, the sensed temperature of the engine coolant is fed to an input terminal 134 to control the conduction of a transistor 136. The emitter of transistor 136 is connected to a node 140, the node 140 being connected between a positive voltage terminal through a resistor 142 and to ground through a resistor 144. The emitter electrode is connected to the node 140 through a resistor 146 and the collector electrode of transistor 136 is connected to conductor 138. Upon increasing conduction of transistor 136, indicating a decreasing sensed temperature, the voltage level at conductor 138 will rise. As is seen from the circuit, the positive input terminal of operational amplifier 110 is connected to the positive potential at terminal 118 through a pair of voltage divider resistors 126, 128. The increased potential at conductor 138 due to the increased conduction of transistor 136 will create a greater voltage drop across the resistor 128 to increase the voltage level at the positive input terminal. This will raise the voltage to which the capacitor 114 must charge and thereby increase the pulse width of the acceleration enrichment pulse at terminal 132 with decreasing temperature.

FIG. 5 illustrates this modification of the single shot multivibrator circuit 26 with sensed coolant temperature. As is seen from FIG. 5, the pulse width will decrease as coolant temperature increases until a breakpoint, designated BP, is reached, at which time the pulse width is no longer effected by coolant temperature.

Figure 6:
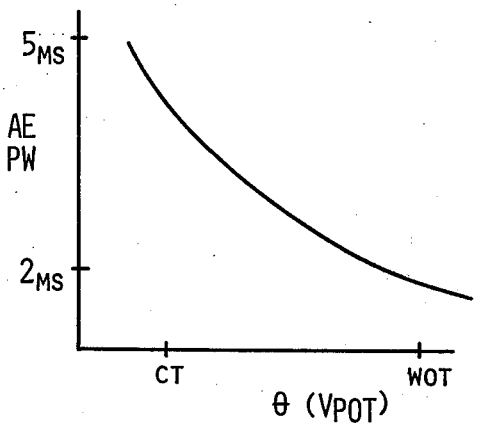
FIG. 6 is a graph illustrating the pulse duration of the acceleration enrichment pulses relative to the angular position of the throttle, and further referencing the closed throttle and wide open throttle positions.

FIG. 6 illustrates the relationship between the pulse width and the throttle position as signalled by the $V_{pot}$ signal. It is seen that the pulse width, for example, will go from a 5 millisecond duration to a 2 millisecond duration as the throttle position is varied from closed throttle position to the wide open throttle position.

Referring now to the closed throttle signal generation circuit 44, it is seen that the signal level on conductor 124 is fed to an operational amplifier 160 by means of a conductor 162. This signal level is fed to the minus input terminal of operational amplifier 160, the positive input terminal being referenced by a signal level at conductor 170 determined by the voltage divider resistors 172 and 174. Accordingly, when the signal level on conductor 162 exceeds the positive voltage being fed to the positive input terminal of operational amplifier 160, the operational amplifier 160 will drop from a high level to a low level as indicated by the signal diagram adjacent the output terminal 164. A suitable feedback resistor 166 is connected between the output terminal and the positive input terminal of the operational amplifier 160 by means of a conductor 168.

Figure 7:
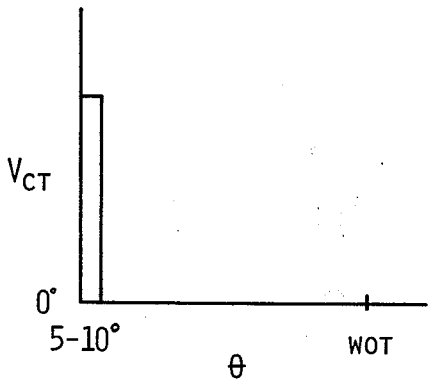
FIG. 7 is a graph illustrating the output voltage signal from the closed throttle signal generating circuit relative to the throttle position and further referencing the closed throttle and wide open throttle positions.

Referring to FIG. 7, it is seen that the angular position of the throttle at closed throttle may vary from approximately 5 to 10 degrees before the signal level at the output of operational amplifier 160 drops from a high to the low level.

Referring to the wide open throttle signal generator circuit, the signal level on conductor 124 is fed to an operational amplifier 180 by means of a conductor 182 and a resistor 184 connected to the plus input thereof. The output of operational amplifier 180 is connected to a wide open throttle signal output terminal 186 and a suitable hysteresis feedback resistor 188 is interconnected between the output of operational amplifier 180 and the positive input thereto. The negative input of operational amplifier 180 is referenced to the voltage at a node 190, the node 190 being supplied a reference voltage from a supply voltage at input terminal 194 by means of resistors 198 and 200 connected to ground at 196. Thus, when the signal level on conductor 182 exceeds the reference potential at 190, for example, at wide open throttle, the operational amplifier 180 will swing from a low to a high level to provide the wide open throttle signal.

While it will be apparent that the embodiments of the invention herein disclosed are well calculated to fulfill the objects of the invention, it will be appreciated that the invention is susceptible to modification, variation and change without departing from the proper scope or fair meaning of the subjoined claims.

I claim:

1. An acceleration enrichment circuit for use with an electronic fuel injection system for controlling the flow of fuel to an internal combustion engine, said system including at least one injector, a throttle and an electronic control unit for controlling the operating of the injector by generating a train of output pulses to pulse the injector, the acceleration enrichment circuit modifying the output pulse train to increase the flow of fuel to the engine in response to predetermined throttle conditions, the acceleration enrichment circuit comprising:

linear potentiometer sensing means connected to the throttle for generating an analog signal proportional to the position of the throttle;

differentiator means connected to said sensing means differentiating said analog signal and generating a rate signal having an amplitude proportional to the rate of change of the throttle position in the opening direction;

voltage controlled oscillator means connected to said differentiator means for generating a frequency modulated signal in response to the amplitude of said rate signal; and a single-shot multivibrator circuit connected to said voltage controlled oscillator means for generating a supplementary train of output enrichment pulses having a duty cycle which varies as a function of said frequency modulated signal and independent of the speed of the engine.

2. The invention of claim 1 further including temperature sensing means for sensing the engine temperature and modifying the operation of said multivibrator circuit means as a function of the sensed engine temperature.

3. The invention of claim 2 wherein said multivibrator circuit includes means for generating a reference voltage, said temperature sensing means generating a temperature signal, said temperature signal altering the effective reference voltage being fed to said multivibrator circuit.

4. The improvement of claim 3 further including function generating circuit means connected to said linear potentiometer sensing means for generating a function signal in response to said analog signal, said function generating circuit means being connected to said multivibrator circuit means for altering the operation of said multivibrator circuit means in response to said function signal.

5. The invention of claim 4 wherein said multivibrator circuit means includes a charging circuit for determining the on-time of said multivibrator circuit means, said function signal altering said charging circuit means.

6. The invention of claim 5 wherein said function signal varies the time constant of said charging circuit.

7. The improvement of claim 4 wherein said temperature signal varies the on-time of said supplementary train of output enrichment pulses as an inverse function of said sensed temperature.

8. The invention of claim 7 wherein said function signal varies the time constant of said charging circuit.

9. The invention of claim 8 wherein said temperature sensing circuit means includes a transistor connected to said temperature sensing means, said temperature sensing means varying the conduction of said transistor to increase said reference voltage in response to decreases in sensed temperature.

10. The invention of claim 1 wherein said voltage controlled oscillator means includes an operational amplifier having first and second input circuits, one of said input circuits being connected to said differentiator means and the second of said input circuits being connected in a feedback loop with the output of said operational amplifier.

11. The invention of claim 10 wherein said voltage controlled oscillator further includes capacitive means connected to said second input, said capacitive means being charged through said feedback loop.

12. The invention of claim 11 wherein said charging of said capacitor determines the on-time of said voltage controlled oscillator means.

13. The invention of claim 12 wherein said operational amplifier includes a resistor connected between the output and the second input of said operational amplifier, said capacitor discharging through said resistor.

14. The invention of claim 13 wherein the discharge time of said capacitor determines the off-time of said voltage controlled oscillator means.

15. The invention of claim 1 wherein said system further includes means for generating a closed throttle signal and means for generating a wide open throttle signal, said latter means being connected to said linear potentiometer sensing means.

* * * * *